US005427253A

United States Patent [19]

Koehler

[11] Patent Number: 5,427,253

[45] Date of Patent: Jun. 27, 1995

[54] TACONITE PELLET SEPARATOR

[76] Inventor: Thomas V. Koehler, 814 5th Ave., Two Harbors, Minn. 55616-1429

[21] Appl. No.: 262,649

[22] Filed: Jun. 20, 1994

[51] Int. Cl.[6] ..... B07C 9/00

[52] U.S. Cl. ..... 209/694; 209/691

[58] Field of Search ..... 209/691, 694

[56] References Cited

U.S. PATENT DOCUMENTS

| | | | |
|---|---|---|---|
| 2,658,616 | 11/1953 | Stutzman | 209/694 X |
| 2,778,498 | 1/1957 | Vincent | 209/694 |
| 2,954,124 | 9/1960 | Young | 209/691 X |
| 3,473,657 | 10/1969 | Graf et al. | 209/694 |
| 3,680,694 | 8/1972 | Hamann | 209/691 X |
| 3,807,554 | 4/1974 | Satake | 209/694 |
| 4,301,931 | 11/1981 | Satake | 209/691 |
| 4,513,867 | 4/1985 | Satake | 209/694 X |
| 4,583,645 | 4/1986 | Yamamoto | 209/691 X |
| 4,765,489 | 8/1988 | Satake | 209/694 X |
| 4,771,894 | 9/1988 | Lapp | 209/694 X |

FOREIGN PATENT DOCUMENTS

| | | | |
|---|---|---|---|
| 1452625 | 1/1989 | U.S.S.R. | 209/691 |

*Primary Examiner*—D. Glenn Dayoan

[57] ABSTRACT

A particle separation apparatus having an adjustable tilted vibratory conveyor, an adjustable material flow control guide, and an adjustable material flow splitter. A heterogenous mixture of taconite pellets and other material is fed to the vibratory conveyor. The different particles flow across the surface of the vibratory conveyor in different paths or trajectories according to the different coefficients of friction and angles of rest inherent in the particles. The different flow paths are split such that one stream of material is chiefly taconite pellets and the other path is made mostly of non-taconite pellet material.

1 Claim, 4 Drawing Sheets

TACONITE PELLET SEPARATOR

BACKGROUND OF THE INVENTION

The present invention relates to the separation of taconite pellets from a heterogeneous mixture of taconite pellets and other matter. Means of effecting such separation is dependent upon the different coefficients of friction and angles of rest, inherent in the various materials to be treated by the invention.

U.S. PATENT DOCUMENTS 4,624,370 Nov. 25, 1986 Danner
4,519,896 May 28, 1985 Vickery
3,749,240 Jul. 31, 1973 Spears
3,036,707 May 29, 1962 Walden
1,517,509 Dec. 2, 1924 Hokanson

SUMMARY OF THE INVENTION

Taconite pellets as manufactured in Minnesota are roughly spherical in shape and generally less than three-fourths of an inch in diameter. Although the pellets are about two-thirds iron, they are non-magnetic and electrically non-conductive. In Minnesota, the taconite pellets are generally transported by railcar from the manufacturing plants to shipping points on the shore of Lake Superior. As a normal consequence of shipping and handling, some pellets are spilled on the ground and railroad rights-of-way. Mechanized sweepers clean the ground and rights-of-way, as needed, yielding as much as several hundred tons of material per day, for a given sweeper. The swept material is a mixture of taconite pellets, track ballast, gravel, and other matter. The swept material must be discarded at a landfill, as it is unsuitable for roadbed, track ballast, or blast furnace feed. The invention is an economical means of separating and recovering taconite pellets from the sweepings mixture. The invention employs a vibratory conveyor which is slightly tilted along the primary axis of material flow across the conveyor. As the sweepings mixture is fed to the vibratory conveyor, materials on the surface of the conveyor travel in different trajectories according to the nature of the materials. Materials with a higher coefficient of friction travel faster on a vibratory conveyor than materials with a lower coefficient of friction. Materials with a lower angle of rest will roll, tumble, or slide downhill at a given angle more readily than other materials with a higher angle. One barrier on the surface of the conveyor guides the moving feed material to a "free-roll" zone on the conveyor surface. Another barrier on the surface of the conveyor divides the moving material into two distinct flow paths. One flow path is chiefly taconite pellets. The other flow path is chiefly non-taconite pellet material. The operator of the invention may control the frequency and amplitude of vibration, the slope of the conveyor surface, and the positions of the barriers, in order to achieve optimum separation of the materials being treated by the invention. The operator of the invention is at liberty to determine the best means of feeding the swept material to the conveyor and retrieving the materials after separation has been effected.

The invention does not rely upon density, particle size or fluidizing properties (Danner.) The invention does not effect separation on the basis of specific gravity (Vickery.) Separation is not effected by means of magnetism, high velocity air streams, or partial vacuum (Spears.) Neither weight nor hardness of the treated particles is material to the operation of the invention (Walden and Hokanson.)

DETAILED DESCRIPTION

Figure 1:
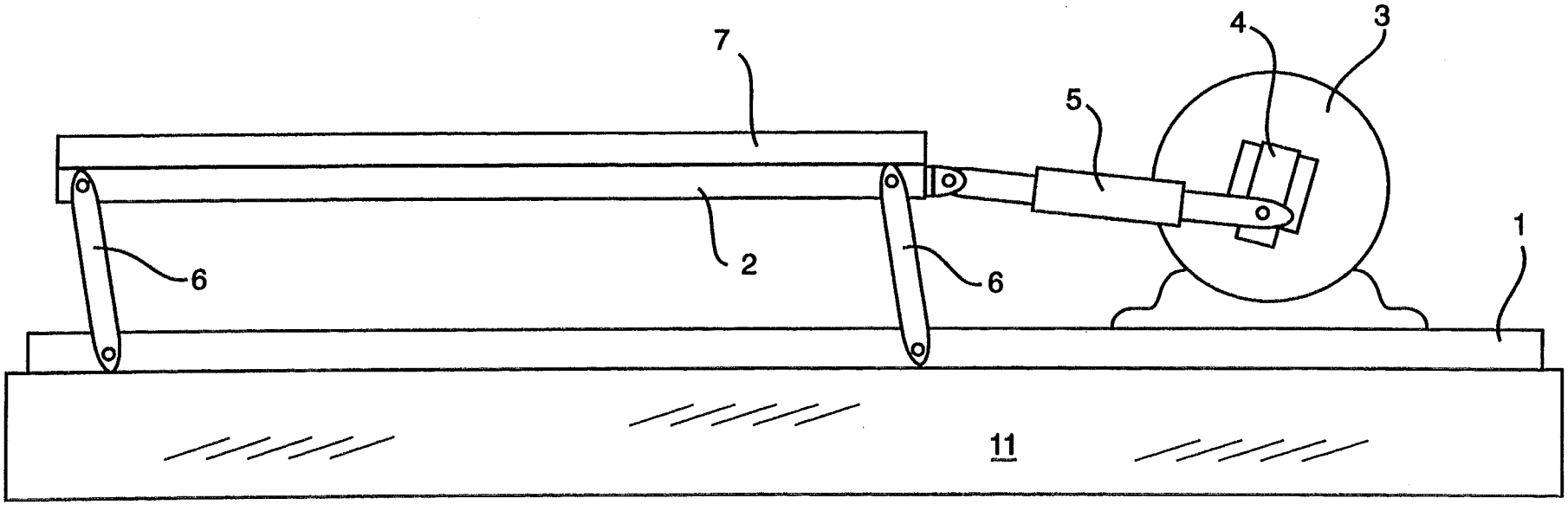
FIG. 1 is a side elevation of the current embodiment of the invention.
Figure 2:
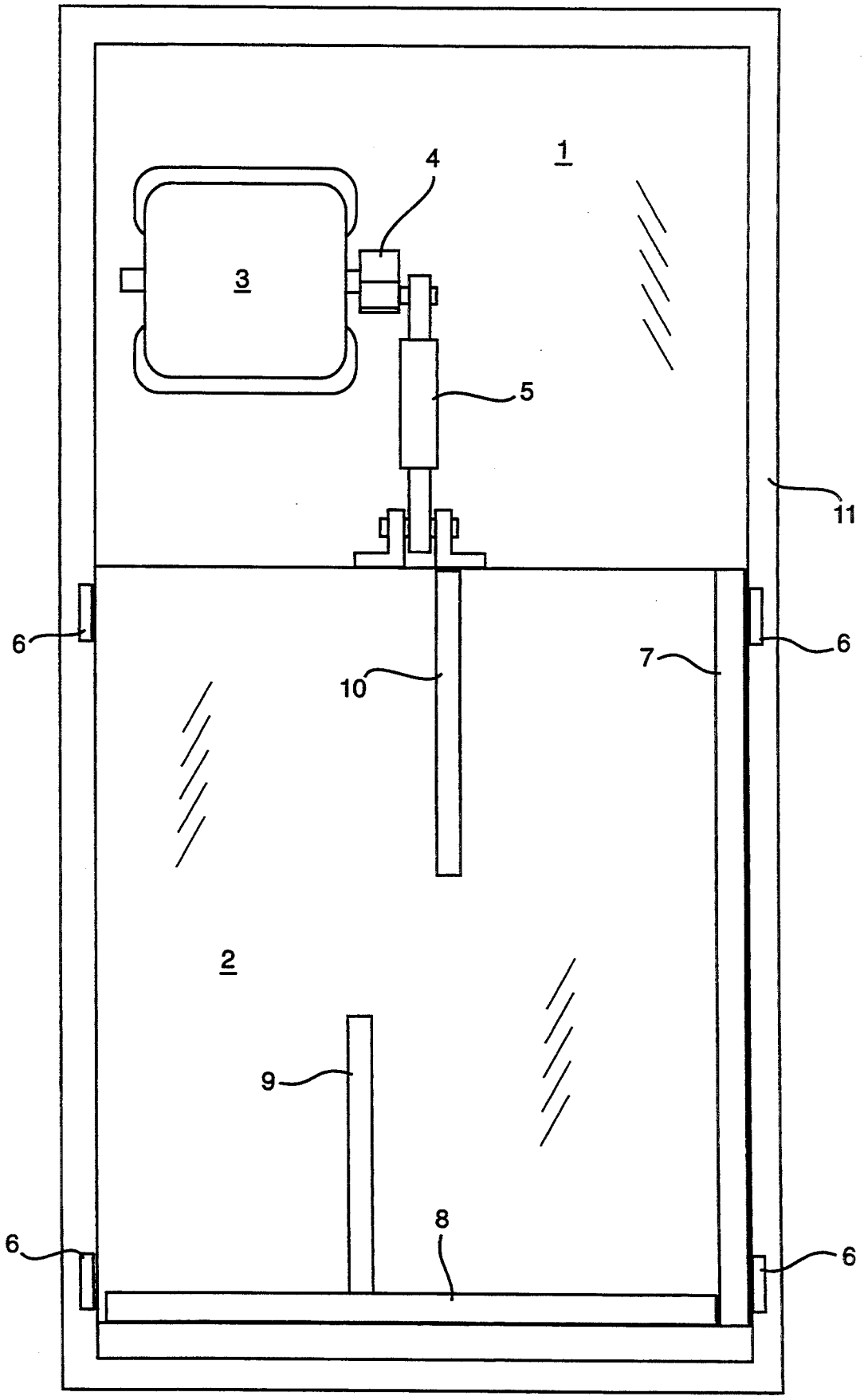
FIG. 2 is a top plan view of the current embodiment of the invention.
Figure 3:
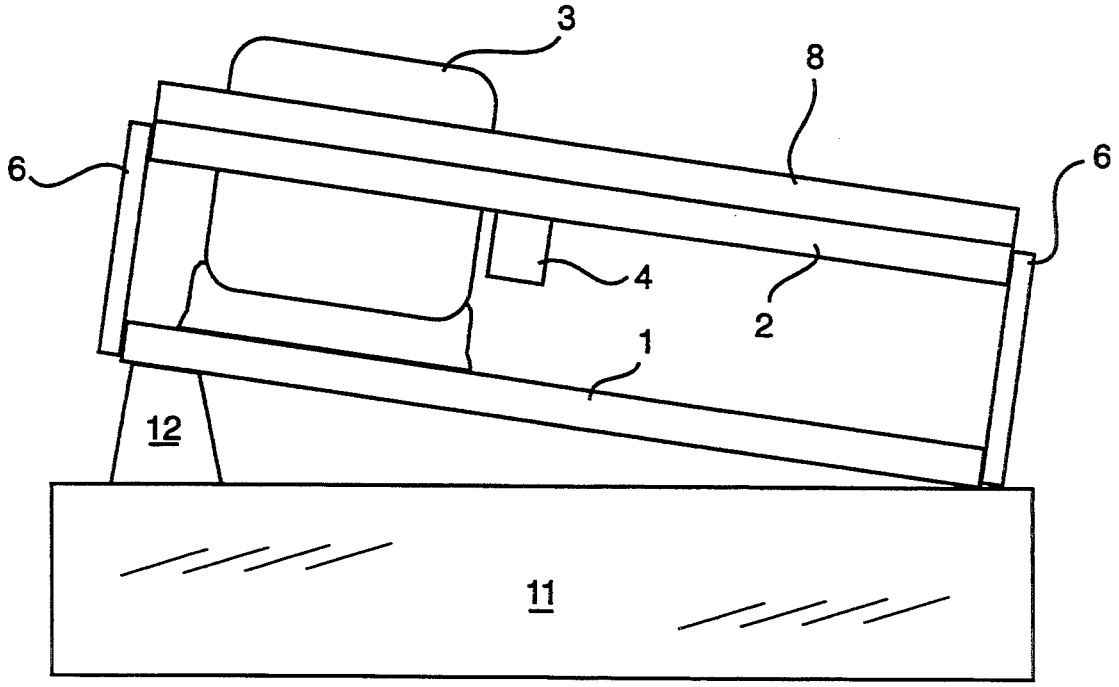
FIG. 3 is an end elevation of the current embodiment of the invention, showing the tilt of the conveyor, as seen from the feed-end.

The embodiment of this invention is of a vibratory conveyor bed 2 coupled to a vibratory conveyor base 1 by means of suitable pivot links 6. A reciprocating action is imparted to the conveyor bed 2 by means of a suitable variable speed drive unit 3 which is made fast to the conveyor base 1. A suitable variable-throw crank 4 is appropriately secured to the output shaft of the drive unit 3. The variable-throw crank 4 is connected to the conveyor bed 2 by adjustable connecting rod 5 using suitable means. In the present embodiment of this invention, containment fences 7 and 8 are made fast to the lower and rear edges of the top surface of the conveyor bed 2. Fastened to the top of the conveyor bed 2 is a feed guide fence 9 which may be repositioned by the operator of this machine for optimum performance. Also fastened to the top of the conveyor bed 2 is a splitter guide fence 10 which may also be repositioned by the operator of this machine for optimum performance. Parts 1 through 10 inclusive, comprise part of the taconite separator, which is securely attached to a level foundation 11 of suitable mass and strength. It will be seen in FIG. 3 that the conveyor base 1 is raised on one edge by suitable support 12 in order to impart a slope to the conveyor bed 2 at right angles to the direction of material flow along the long axis of the taconite separator. The degree of slope may be adjusted by changing the height of the support 12 to afford the best performance of the taconite separator.

Figure 4:
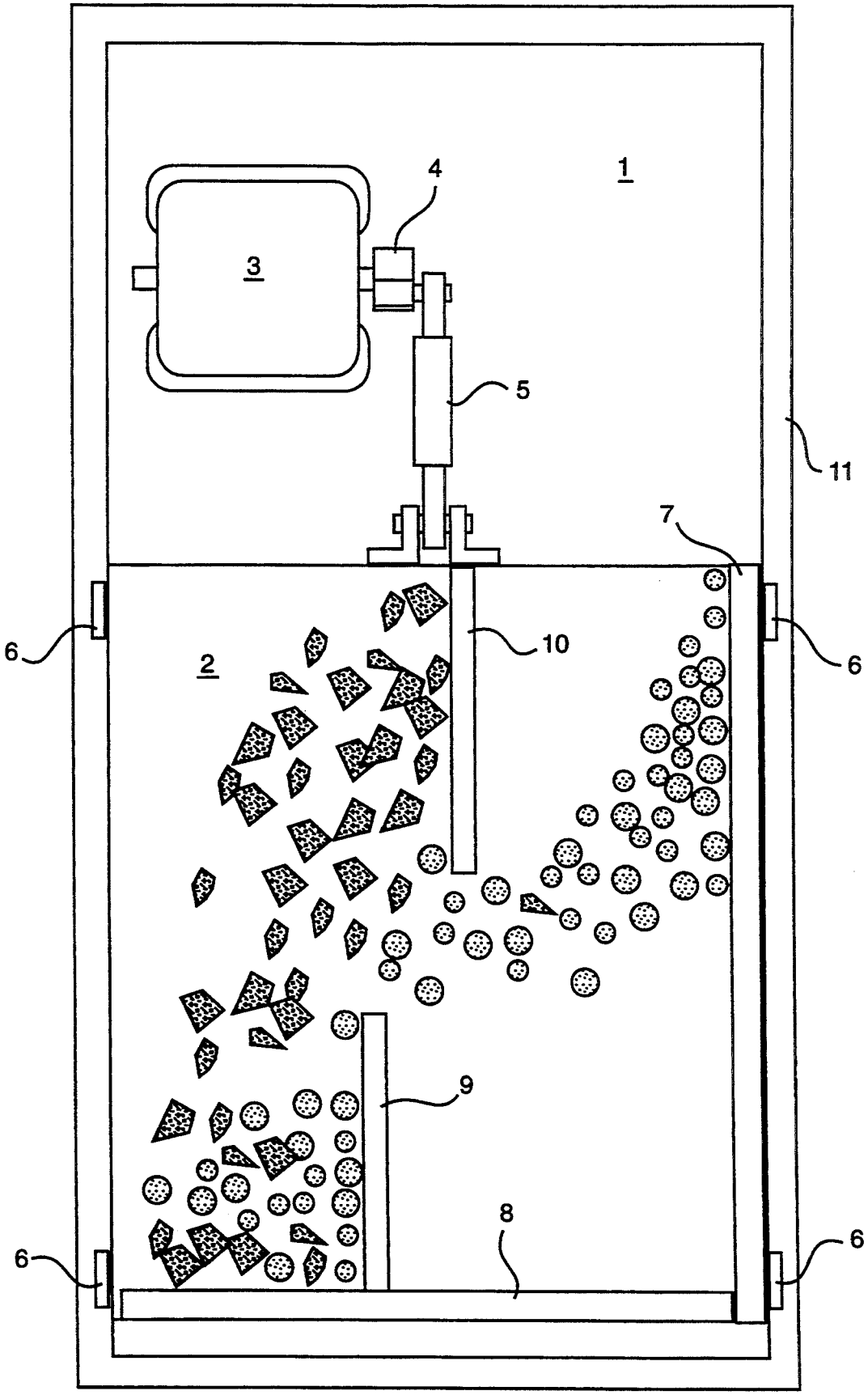
FIG. 4 is a top plan view of the current embodiment of the invention, showing the feed mixture on the conveyor bed and the separation of the materials into two flow paths.

FIG. 4 shows a feed mixture of taconite pellets and track ballast on the conveyor bed 2. As the feed mixture travels away from the rear containment fence 8 the feed mixture also tends to travel downhill towards the lower containment fence 7. The taconite pellets travel more slowly longitudinally, and downhill more quickly, than the track ballast or other non-taconite material. Two different particle flow paths can be observed in the operation of this machine, and the splitter guide fence 10 is positioned in such a manner as to trap the non-taconite material, ensuring that it stays separated from the taconite pellets. Suitable means for collecting the two different materials is then provided at the discretion of the person or persons operating the taconite separator.

Since several suitable means are already in existence for feeding material to this taconite separator, none is shown in this embodiment of the taconite separator.

Since suitable means are already in existence for prescreening the feed material to remove any particles which are substantially larger than the taconite pellets, none is shown in this embodiment of the taconite separator.

Since suitable means are already in existence for removing magnetic or electrically conductive materials from the feed material, none is shown in this embodiment of this taconite separator.

I claim:

1. A device for the separation of a homogeneous mixture of materials into one portion comprising substantially spherical matter and another portion comprising substantially non-spherical matter, the device comprising a conveying means to accelerate said homogeneous mixture in a first direction from an upstream end to a downstream end of said conveying means and variably tilting the plane of said conveying means in such a manner as to provide a second acceleration to said homogeneous mixture, due to the effects of gravity, in a second direction generally right angles to the first direction, whereby initial separation of the homogeneous mixture is effected by the second acceleration of the homogeneous mixture in the second direction from a higher portion of the convyeing means to a lower portion of the conveying means in combination with the first acceleration in the first direction of the mixture; the device further comprising a feed guide fence adjacent the surface of the upstream end of the conveying means which initially constrains said homogeneous matter in position and direction of movement to the higher portion of said conveying means, a long axis of said feed guide fence being parallel to the first direction; and a splitter guide fence adjacent the surface of the downstream end of the conveying means for effecting final separation of said homogeneous mixture into two discrete flow paths.

* * * * *